United States Patent [19]

Giebeler

[11] Patent Number: 4,833,891

[45] Date of Patent: May 30, 1989

[54] ROTOR TEMPERATURE CONTROL AND CALIBRATION

[75] Inventor: Robert Giebeler, Cupertino, Calif.

[73] Assignee: Beckman Instruments, Inc., Fullerton, Calif.

[21] Appl. No.: 53,171

[22] Filed: May 22, 1987

[51] Int. Cl.[4] ..... B04B 9/10

[52] U.S. Cl. ..... 62/65; 374/133; 494/1

[58] Field of Search ..... 62/65; 374/133; 494/1

[56] References Cited

U.S. PATENT DOCUMENTS 3,347,453 10/1967 Goergen ..... 494/1

3,409,212 11/1968 Durland et al. ..... 374/133 X

*Primary Examiner*—William E. Wayner

*Attorney, Agent, or Firm*—William H. May; Paul R. Harder

[57] ABSTRACT

To enable centrifuging to occur at precisely determined sample temperatures, a method of centrifuge calibration which permits rapid and accurate refrigeration of the rotor containing the sample is disclosed. A rotor with sample to be centrifuged is placed within a centrifuge can. Temperature of the radiometer $T_{ra}$, and temperature of the surrounding refrigerating can $T_c$ is determined at a first time, $t_0$. Thereafter, and at a second time $t_1$, temperature of the radiometer $T_{ra}$, and the temperature of the surrounding refrigerating can $T_c$ are equilibrated. The temperature excursion between $t_0$ and $t_1$ for the temperatures of the radiometer $T_{ra}$ and the temperature of the refrigerating can $T_c$ are measured to yield respective $\Delta T_{ra}$ and $\Delta T_c$. The radio of $\Delta T_{ra}/\Delta T_c$ is taken to give a constant which comprises the view factor from the radiometer for the particular shape of rotor and the surrounding can. Thereafter, the temperature of the rotor Tr will equal the temperature of the radiometer plus the temperature of the radiometer minus the temperature of the refrigerating can $T_c$ times the determined view factor. It is thereafter possible to maintain a large temperature differential between the refrigerating can and the rotor and bring the rotor (and necessarily the sample) rapidly to a precise temperature where centrifuging can rapidly follow.

3 Claims, 1 Drawing Sheet

ROTOR TEMPERATURE CONTROL AND CALIBRATION

BACKGROUND OF THE INVENTION

This invention relates to centrifuges. Moreover, this invention discloses a process whereby a centrifuge can remotely determine the radiometer view factor of differing shaped rotors and remotely cool a rotor and necessarily a contained sample to a precise temperature for centrifuging.

SUMMARY OF THE PRIOR ART

Centrifuging must occur at precise sample temperature for optimum results. For example, in the case of biological samples, the preferred temperature at the sample and rotor is usually 0° C.

To determine precisely rotor temperatures, radiometers are utilized. These radiometers view the rotor, and determine the temperature of the rotor. Where the rotor is not at the precise temperature, a large surrounding refrigerating can is utilized. By maintaining the temperature of the can at differential with respect to the temperature of the rotor, the rotor can be brought down to the specific temperature required for centrifuging.

It is known that radiometers do not just view the rotor when determining the temperature of the rotor. The radiometers also view the surrounding refrigerating can. The amount of the rotor that is viewed and the amount of the surrounding refrigerating can that is viewed vary. This variation is dependent upon many factors including the shape of the rotor, the material of which the rotor is constructed, the thermal emissions of the can and the like.

The view of the radiometer of the rotor and the view of the radiometer of the surrounding refrigerating is expressed as a ratio. This ratio is a constant and is known as the "view factor" of the radiometer for a particular rotor.

Complicating this problem is the substitution of differing rotors for differing purposes in centrifuges. The rotors have many various configurations and compositions. The view factor of such rotors has heretofore been assumed. Consequently, when cooling for centrifuging is undertaken and completed, error is inevitably present.

Accelerated cooling of rotors using previously determined "view factors" is known.

SUMMARY OF THE INVENTION

To enable centrifuging to occur at precisely determined sample temperatures, a method of centrifuge calibration which permits rapid and accurate refrigeration of the rotor containing the sample is disclosed. A rotor with sample to be centrifuged is placed within a centrifuge can. Temperature of the radiometer $T_{ra}$, and temperature of the surrounding refrigerating can $T_c$ is determined at a first time, $t_0$. Thereafter, and at a second time $t_1$, temperature of the radiometer $T_{ra}$, and the temperature of the surrounding refrigerating can $T_c$ are equilibrated with the resultant thermodynamics causing the radiometer to seek the temperature of the rotor. The temperature excursion between $t_0$ and $t_1$ for the temperatures of the radiometer $T_{ra}$ and the temperature of the refrigerating can $T_c$ are measured to yield respective $\Delta T_{ra}$ and and $\Delta T_c$. The radio of $\Delta T_{ra}/\Delta T_c$ is taken to give a constant which comprises the view factor from the radiometer for the particular shape of rotor and the surrounding can. Thereafter, the temperature of the rotor Tr will equal the temperature of the radiometer plus the difference in temperature between the refrigerating can $T_c$ and the radiometer ($T_{ra}$) times the determined view factor. It is thereafter possible to maintain a large temperature differential between the refrigerating can and the rotor and bring the rotor (and necessarily the sample) rapidly to a precise temperature where centrifuging can rapidly follow.

OBJECTIONS AND ADVANTAGES

An object of this invention is to disclose a method of rotor calibration which will automatically calibrate any rotor placed in a centrifuge. The method enables rapid cooling to a precise processing temperature of a sample contained within the rotor. It is not necessary or required for the centrifuge operator to insert any rotor parameters. Thus, centrifuge operation can occur even where rotors of third party suppliers are utilized.

A further object of this invention is to disclose a software operated optimum cooling cycle for centrifuged samples. According to this aspect of the invention, a flow diagram can sample program listings for the disclosed method of optimum cooling is provided. This software requires no input of rotor parameters; it is only necessary that the disclosed cycle occurs.

BRIEF DESCRIPTION OF THE DRAWINGS

Referring to FIG. 1 a centrifuge is schematically illustrated. Simply stated, a refrigerating can C completely surrounds a rotor R. Can C is sealed at the top by a vacuum tight seal through wall 16. The can C is typically refrigerated electrothermally by apparatus not shown. Typically, a sample S within the rotor R is centrifuged about a spin axis 20 at extreme high rotational velocities. Such velocities can reach 100,000 revolutions per minute.

The problem addressed here is the precise cooling of rotor R before centrifuging occurs. This specification will first state the problem and thereafter set forth the solution.

Figure 1:
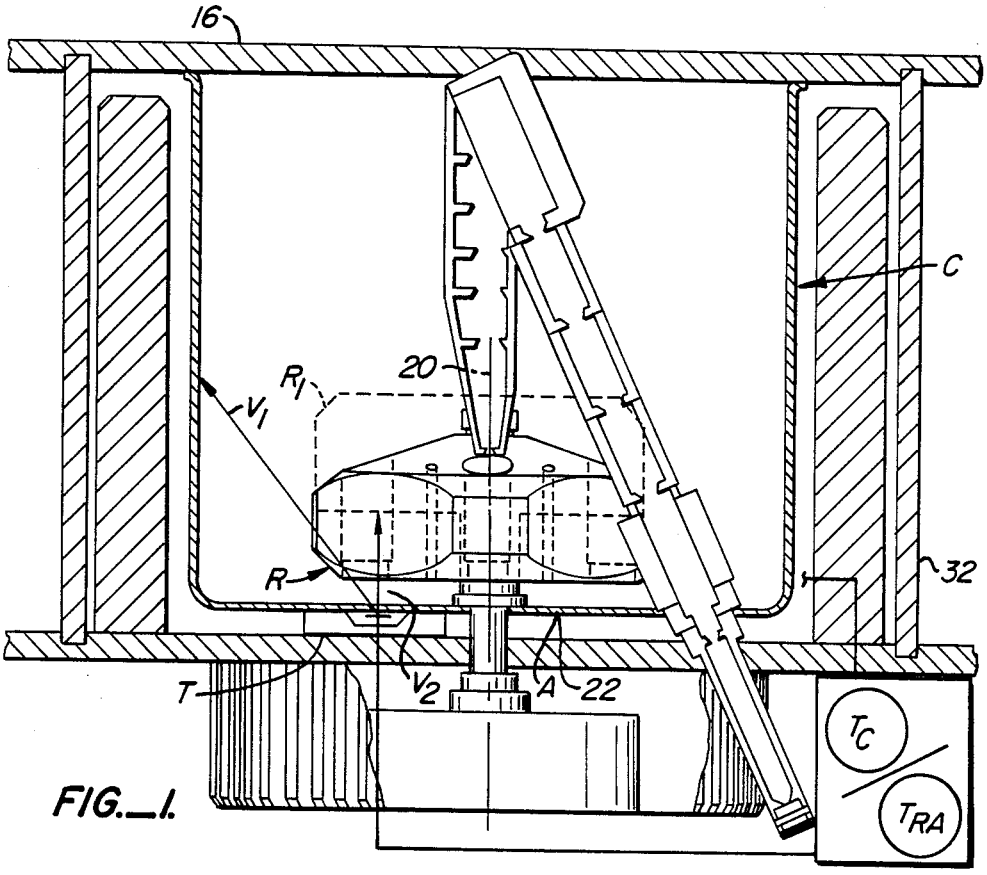
FIG. 1 is a side elevation section of a typical centrifuge illustrating schematically in broken lines two typical rotor configurations with differing "view factors" and illustrating schematically thermal instrumentation for monitoring the can, refrigerating the can, and determining the temperature of the rotor.

Regarding the problem, it can be seen from the side elevation of FIG. 1 that more than one rotor R is illustrated. The first rotor R (shown in solid lines) has a low profile and is immediate the bottom wall 22 of the can C. A second rotor $R_1$ is illustrated in broken lines. This rotor is elevated with respect to the bottom surface 22 of can C.

In order to understand the problem, the two rotors can be discussed in their disposition with respect to the radiometer T.

Figure 2:
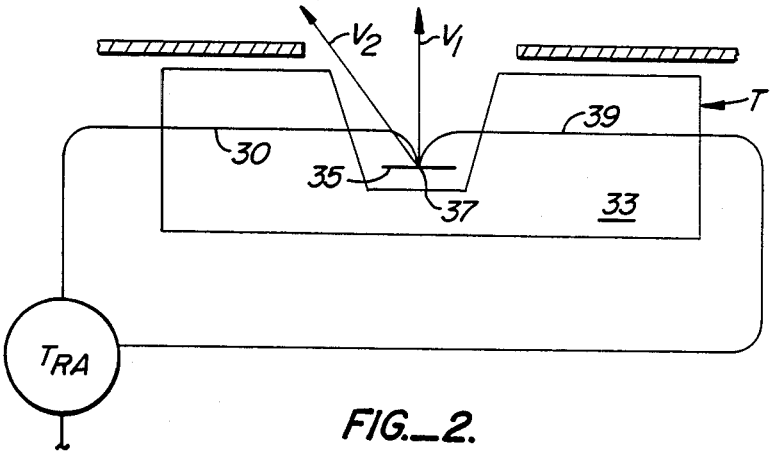
FIG. 2 is a side elevation section at the radiometer of the instant invention illustrating schematically the view factor of the radiometer.

Referring to FIG. 2, a schematic of the construction of the radiometer is illustrated. Specifically, the radiometer includes at least one bimetallic connection from an electrical lead 30 passing through a radiometer body 33 to a heat absorbing disk 35. A bimetallic electrical junction at 37 on disk 35 electrically transmits to lead 39 the temperature.

Viewing the radiometer of FIG. 2. two arrows schematically illustrate the "view" that disk 35 has of the environment relating to either rotor R or rotor $R_1$. A first view indicated by arrow $V_1$ is in the direction of the respective rotor. A second arrow $V_2$ is in the direction of the can C sidewalls.

Stopping at this juncture and referring to the view of FIG. 1, it can be seen that when rotor R is substituted and rotor $R_1$ is placed in the centrifuge this so-called "view" will change. With the higher profile rotor it will naturally be expected that the radiometer T will have a greater solid angle of view of the can C.

This problem is not merely a function of rotor shape. Specifically, the heat content of the rotors, color of the rotors, and even the sample can all change the variations of "view" of the radiometer T It is possible to arbitrarily observe for each of the rotors R, $R_1$, the "view" of the radiometer. However, this requires calibration of a particular rotor to a particular centrifuge; this is ofttimes impractical.

Having set forth the difficulties, the process can be simply stated. Typically either of the rotors with the sample to be centrifuged is prerefrigerated and brought into a temperature range which is roughly in line with that at which centrifuging will occur. Thereafter, the rotor is placed within the centrifuge can.

Temperature of the radiometer $T_{ra}$ and temperature of the surrounding refrigerating can $T_c$ is determined at a first time $t_O$. Thereafter, and at a second time $t_1$ the temperature of the radiometer $T_{ra}$ and the temperature of the surrounding refrigerating can $T_c$ are equilibrated. That is to say they are brought as closely as possible together. This second equilibrated temperature is necessarily the temperature of the rotor.

It will be understood that the total heat content of the rotor is much larger than the heat content of the can and especially the radiometer. Accordingly, this calibration routine relies on the fact that rotor temperature excursion during calibration is de minimus.

The temperature excursion between $t_0$ and $t_1$ for the radiometer on one hand $\Delta T_{ra}$ and the temperature of the refrigerating can $T_c$ are measured. These measurements yield respective $\Delta T_{ra}$ and $T_c$. The ratio of $\Delta T_{ra}$ to $\Delta T_c$ is taken to give a constant. The constant provides the so-called "view factor" from the radiometer. This "view factor" is for a particular shape, color, and kind of rotor. By virtue of the process disclosed, the rotor and can are customized as to any local parameters which may be prevent either in the centrifuge or the introduced rotor.

Determination of the exact temperature of the rotor when can is at any temperature is then easily accomplished. The temperature of the rotor $T_r$ will equal the temperature of the radiometer minus the temperature of the radiometer $T_{ra}$ plus the temperature of the refrigerating can $T_c$ times the determined view factor. It may be expressed:

$$T_r = T_{ra} + U(T_c - T_{ra})$$

Once it is possible to accurately track the "view factor" for a particular centrifuge and a particular inserted rotor, cooling of the rotor to a precise temperature for centrifuging can rapidly follow. Specifically, a large temperature differential will be maintained between the can C and the rotor R. This large temperature differential will cause rapid cooling. This temperature will be maintained until such time as the rotor closely approaches the rotor temperature at which the sample is to be processed.

Thereafter, the can will be equilibrated with the rotor. Typically this equilibration will precisely occur at the processing temperature.

The disclosed calibration cycle takes less less than 3 mins. When compared to typical rotor cooling times, in the order of several hours, the automated calibration process here disclosed is possible because rotor will change less than 0.1° C. during the process.

It will also be realized that the disclosed process is capable of being microprocessor based.

What is claimed is:

1. A method of cooling a rotor within a centrifuge having a radiometer for determining the temperature of said rotor and a surrounding refrigerating can for cooling said rotor to a precise temperature for centrifuging, said method comprising the steps of:

placing the rotor within the refrigerating can;

measuring the temperature of said radiometer and said surrounding refrigerating can at a first time;

equilibrating the temperature of said surrounding refrigerating can to the temperature of said radiometer whereby said radiometer equilibrates to the temperature of said rotor at said second time;

determining the view factor of said rotor and said can from said radiometer by constructing a ratio of the temperature excursion of said surrounding refrigerating can from said first time to said second time over the temperature excursion of said radiometer from said first time to said second time; and, cooling said rotor utilizing said determined view factor to measure that fraction of the reading of the radiometer which is attributed to the temperature of said rotor.

2. A method for determining the view factor of a centrifuge rotor from a radiometer located in a centrifuge within a refrigerated can comprising the steps of:

placing said rotor within the refrigerating can;

measuring the temperature of said radiometer and said surrounding refrigerating can at a first time;

equilibrating the temperature of said surrounding refrigerating can to the temperature of said radiometer whereby said radiometer equilibrates to the temperature of said rotor;

determining the view factor of said rotor and said can from said radiometer by constructing a ratio of the temperature excursion of said surrounding refrigerating can from said first time to said second time over the temperature excursion of said can from said first time to said second time.

3. Apparatus for determining the view factor of a centrifuge rotor placed within a centrifuge, said apparatus comprising:

a refrigerating can for containing a centrifuge rotor;

a centrifuge rotor placed within said refrigerated can for cooling and centrifuging;

a radiometer within said refrigerated can for measuring the temperature of said rotor, said radiometer having a view of the rotor and surrounding can whereby the temperature of said radiometer combines the temperature of said rotor with the temperature of said can;

means for measuring and recording the temperature of said refrigerated can;

means for measuring and recording the temperature of said radiometer; and, means for equilibrating the temperature of said radiometer to the temperature of said refrigerating can whereby said radiometer equilibrates to the temperature of said rotor;

means for determining the ratio of the temperature excursion of the surrounding refrigerating can over the temperature excursion of the radiometer whereby said ratio constitutes the view factor of said rotor from said radiometer.

* * * * *

UNITED STATES PATENT AND TRADEMARK OFFICE

CERTIFICATE OF CORRECTION

PATENT NO. : 4,833,891

DATED : May 30, 1989

INVENTOR(S) : Robert Giebeler

It is certified that error appears in the above-identified patent and that said Letters Patent is hereby corrected as shown below:

On the title page inventor should read

--(75) Inventors: Robert Giebeler, Cupertino, California and Douglas H. Durland, Palo Alto, California--.

Signed and Sealed this

Tenth Day of April, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,833,891

DATED : May 30, 1989

INVENTOR(S) : Robert Giebeler

It is certified that error appears in the above-identified patent and that said Letters Patent is hereby corrected as shown below:

| | |
|---|---|
| Column 1, line 66, | delete "radio" and insert --ratio-- |
| Column 2, line 43 and 44, | after "apparatus" delete "not shown" and substitute --A-- |
| line 44, | after "sample" delete "S" |
| Column 3, line 28, | after $T_c$ insert --at 32-- |
| line 43, | delete "$T_c$" and substitute --$\Delta T_c$-- |
| line 54, 55 and 56, | delete "minus the temperature of the radiometer $T_{ra}$ plus the temperature of the refrigerating can $T_c$ times the determined view factor" and substitute --$T_{RA}$ plus the view factor times the difference between the temperature of the refrigerated can $T_c$ and the temperature of the radiometer $T_{RA}$--. |

UNITED STATES PATENT AND TRADEMARK OFFICE

CERTIFICATE OF CORRECTION

PATENT NO. : 4,833,891

DATED : May 30, 1989

INVENTOR(S) : Robert Giebeler

It is certified that error appears in the above-identified patent and that said Letters Patent is hereby corrected as shown below:

Column 4, line 58 after "radiometer" insert --having a view of thermal radiation--

Signed and Sealed this

Twenty-first Day of May, 1991

*Attest:*

HARRY F. MANBECK, JR.

*Attesting Officer*

*Commissioner of Patents and Trademarks*